US006115866A

United States Patent [19]

Trummer

[11] Patent Number: 6,115,866

[45] **Date of Patent: *Sep. 12, 2000**

[54] PORTABLE GOLF CLUB HEAD CLEANER

[76] Inventor: Marcus A. Trummer, 141 Broken Rock Dr., Henderson, Nev. 89014

[ * ] Notice: This patent is subject to a terminal disclaimer.

[21] Appl. No.: 09/327,918

[22] Filed: Jun. 8, 1999

Related U.S. Application Data

[63] Continuation-in-part of application No. 08/870,431, Jun. 6, 1997, Pat. No. 5,915,432.

[51] Int. Cl.[7] ..... A46B 13/02

[52] U.S. Cl. ..... 15/23; 15/21.1

[58] Field of Search ..... 15/22.1, 21.1, 15/23, 24, 28, 34, 38

[56] References Cited

U.S. PATENT DOCUMENTS

| | | | |
|---|---|---|---|
| 1,019,672 | 3/1912 | Lineback | 15/34 |
| 1,109,088 | 9/1914 | Taylor | 15/23 |
| 3,066,336 | 12/1962 | Stobbe | 15/21.1 |
| 3,276,060 | 10/1966 | Stokes | 15/21.1 |
| 3,332,099 | 7/1967 | Reiter | 15/21.1 |
| 3,551,933 | 1/1971 | Jaeger | 15/34 |
| 3,729,761 | 5/1973 | Lashlev | 15/34 |
| 3,831,217 | 8/1974 | Odawara | 15/34 |

FOREIGN PATENT DOCUMENTS

| | | | |
|---|---|---|---|
| 2701657 | 8/1994 | France | 15/21.1 |
| 9319658 | 10/1993 | WIPO | 15/23 |

*Primary Examiner*—Randall E. Chin
*Attorney, Agent, or Firm*—David O'Reilly

[57] ABSTRACT

A portable golf club head cleaning device comprised of a contoured housing allowing it to be easily held in the hand that has a plurality of brushes operated by a micro-motor and rechargeable batteries. The portable golf club head cleaner has an insertion slot for receiving a golf club head and either a manually operated or automatically operated switch for activating the system to rotate the brushes for cleaning debris from the face of the club. An exit port at the rear of the portable golf club head cleaning module discharges debris cleaned from the club face. Optional features include a circuit that permits boosting the speed of the brushes for club head cleaning and a method for moistening club head for cleaning stains from the club face. The golf club head cleaning module has a series of vertical and horizontal brushes forming a cavity for receiving a golf club head to simultaneously clean the face, the top, and the bottom of the club. The series of cleaning brushes are linked to a micro-motor through a series of shafts and gears. This arrangement allows simultaneously driving multiple brushes with a single motor.

22 Claims, 5 Drawing Sheets

PORTABLE GOLF CLUB HEAD CLEANER

BACKGROUND OF THE INVENTION

This Application is a Continuation-In-Part of application Ser. No. 08/870,431, filed Jun. 6, 1997, now U.S. Pat. No. 5,915,432.

FIELD OF THE INVENTION

This invention relates to cleaners for golf club heads and more particular relates to a portable golf club head cleaner.

BACKGROUND OF THE INVENTION

In the game of golf it is extremely important to keep the clubs free from dirt and contamination. Any debris can alter a well-placed shot by a few degrees, and depending on the club, this could be anywhere from a few feet to hundreds of feet. The present spectrum of devices and brushes available to golf consumers are inaccurate and usually consume valuable time in application. One method to clean club is to use dampened towel to clean the club head manually. This gets the player's hands wet which could cause the golfer to lose his/her grip on a club when playing the next shot. Another method is to manually apply a dry brush vigorously over the face of the club.

There are also devices which are large and cumbersome and have a reservoir for storing water and brushes at the entrance to the reservoir. The club is inserted through the entrance and brushes into the water and then vigorously agitated against the brushes. These are generally slow and ineffective devices and require a certain amount of dexterity. Also these devices require water and are very large in structure. Some machines stand several feet tall and have numerous brushes operated by electrical current for cleaning clubs. They are not readily available for use during play. There is no present method or device available to provide a deep cleaning of the entire club heads simultaneously while the golfer is playing a round of golf. Thus, there is a need for a device that can instantly and automatically clean a club head while a golfer is on the course.

BRIEF DESCRIPTION OF THE INVENTION

Based on the problems associated with the present club head cleaning products the club head cleanup of the present invention resolve these problems by cleaning the entire club head without requiring any physical exertion on the part of the golfer or the danger of the golfer getting his hands wet. The invention described below may be used to economically and efficiently clean golf club heads and deep clean the grooves of irons by simply inserting a club head into the module having an entrance that is larger than the conventional golf club head. The purpose of portable golf club head cleaner described herein is to enhance the play of golfers by providing them with clean clubs after every shot during play. After each stroke a player can utilize the hand-held portable golf club cleaning device which is accessible and may be attached to any existing golf bag or to a golfer's electric cart. The player inserts a club head into an opening in the module and begins operation by depressing an on/off button or engages a switch at the entrance which automatically begins operation. A micro-motor, powered by rechargeable batteries with the help of gearing technologies, initiates the rotating bristles to deep clean the club head.

The portable golf club head cleaner has an opening protected by a resilient membrane and a plurality of rotating brushes which engage the face, the top, and the bottom of the club head. Generally the back of the club does not contact the ball and, therefore, does not need the rigorous cleaning that the portions of the club that contact the ball and the ground do. Generally the portable golf club head cleaner does not require any moisture applied to the clubs as the brushes are driven at a brisk pace to scrub the club head clean after each shot.

In an optional but preferred embodiment a small reservoir of water may be provided to allow the face of the club head to be moistened or slightly dampened before insertion into the golf head cleaners. The brushes in the club head cleaner are driven by a micro-motor and rechargeable battery allowing 270° cleaning to the face, top, and bottom of the club. Thus the entire club head is cleaned simultaneously with multiple sets of briskly rotating brushes with debris being channeled through the club head module out through a designated exit hole.

The above and other objects, advantages, and novel features of the invention will be more fully understood from the following detailed description and the accompanying drawings, in which:

DETAILED DESCRIPTION OF THE INVENTION

Figure 1:
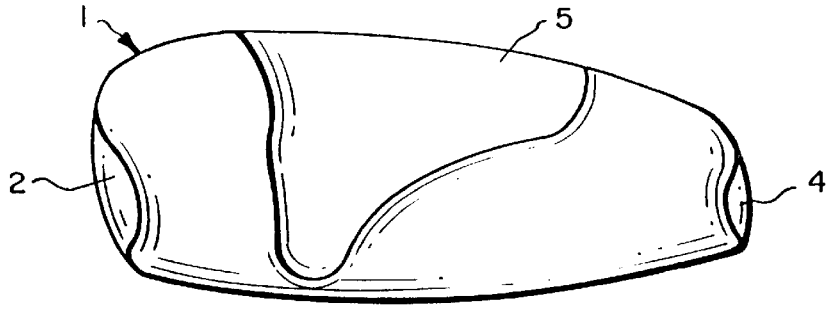
FIG. 1 is a side elevation view of the golf club head cleaning module having club head entry, exit hole, and contoured molded enclosure.

The golf club head cleaner of the invention is constructed to be portable and easily carried by a player in one hand. The portable golf club head cleaner provides an efficient cleaning device that can be attached to a golf bag, pull cart, electric golf cart or similar golfing equipment. It will also be valued by golfers because the portable golf club head cleaner is electrically powered by rechargeable batteries and does not require any manual operation which is a boon to the golfer for use on the course during play. The golf club head cleaning module 1 has a contoured housing 5 with an inlet 2 and an outlet 4 for debris as illustrated in FIG. 1. Finger grip contoured housing 5 houses a micro-motor 19, cylinder 8 lined with bristles 10 and an entrance slot 15 for insertion for a golf club head. Golf club head cleaning module 1 facilitates operation by being activated by power button 3 conveniently located on contoured motored housing 5 conveniently positioned for operation by the user's index finger. Depression of the activating on/off button 3 causes electrical current to be sent to micro-motor 19 to power and operate brushes 10.

Micro-motor 19 is powered by rechargeable batteries 22 connected through battery tabs 23 and tab connectors 24. Micro-motor 19 engages a power shaft 13 that initiates the operation of shaft 9 to rotate the brushes. Shaft 9 provides rotation through multiple gears 12 to three sets of cylinders 8 having brushes 10. The specialized bristles 10 on cylinders 8 rotate creating a large cleaning area that can negotiate over the entire face of club head 6 and respective club head grooves 7.

The operation of the portable club head cleaner is illustrated in FIGS. 1 through 8 is as follows. A golfer holds club head cleaning module in one hand with entrance or insertion hole 15 pointing to the side. This leaves the exit hole 4 pointing away from the user. The golfer grips the module on the top and side utilizing the contoured molded housing 5 as a reference. For the manually operated embodiment, the golfer places an index finger on the contour molding and the on/off button 3. A club head may then be inserted through entrance slot 15 into the cleaning area. Preferably the golfer will hold the club face up with the module down and depress the operating on/off button 3 to clean the club face of a club.

The club head cleaning module is illustrated in FIG. 1 which illustrates the core external components. These components are the contoured molded housing 5 allowing the golfer to conveniently grip the club head cleaning module in one hand, a front opening 2, and an exit opening 4. Preferable the club head cleaning module 1 is comprised of upper and lower molded housing which are constructed of either plastic, wood, or equivalent material. The molded contoured housing 5 houses the functional components described in greater detail hereinafter.

Figure 2:
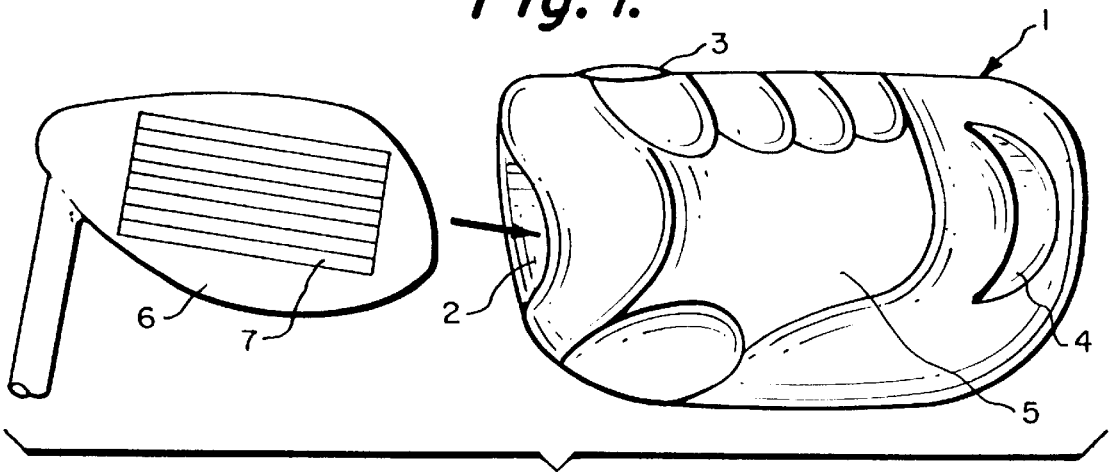
FIG. 2 is a top view of the golf club head cleaning module illustrating the contour of the housing and the operation by inserting a club head into the club head cleaning module entrance.

FIG. 2 is a top plan view illustrating operation of the portable club head cleaning module by holding module 1 in one hand while inserting club head 6 with the other hand. A golfer may hold the club head cleaning module in one hand in front of them and insert club head 6 into the cleaning entrance slot 15 with the other hand. Debris is discharged through exit hole 4 away from the golfer.

With the module held in a horizontal position as shown in FIG. 2 club head 6 is inserted straight into the entrance slot 15 and the on/off button 3 compressed to begin the cleaning process. Bristles 10 on cylinders 8 engage the club head and discharge debris and contaminating material out exit hole 4.

Figure 3:
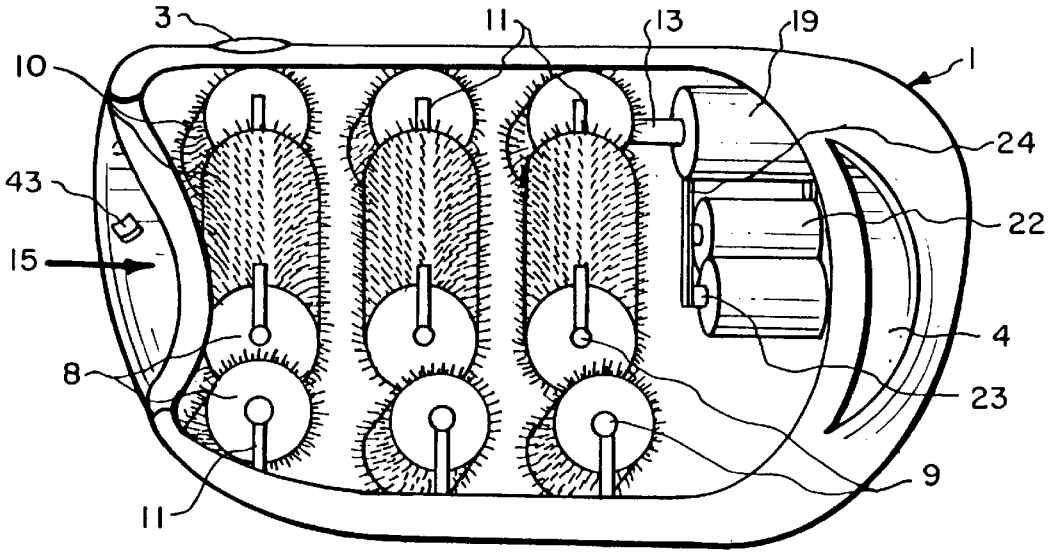
FIG. 3 is a top plan view club head cleaner with a portion of the cover removed to expose the functional cleaning compartment which include vertical brushes and one set of horizontal brushes.
Figure 8:
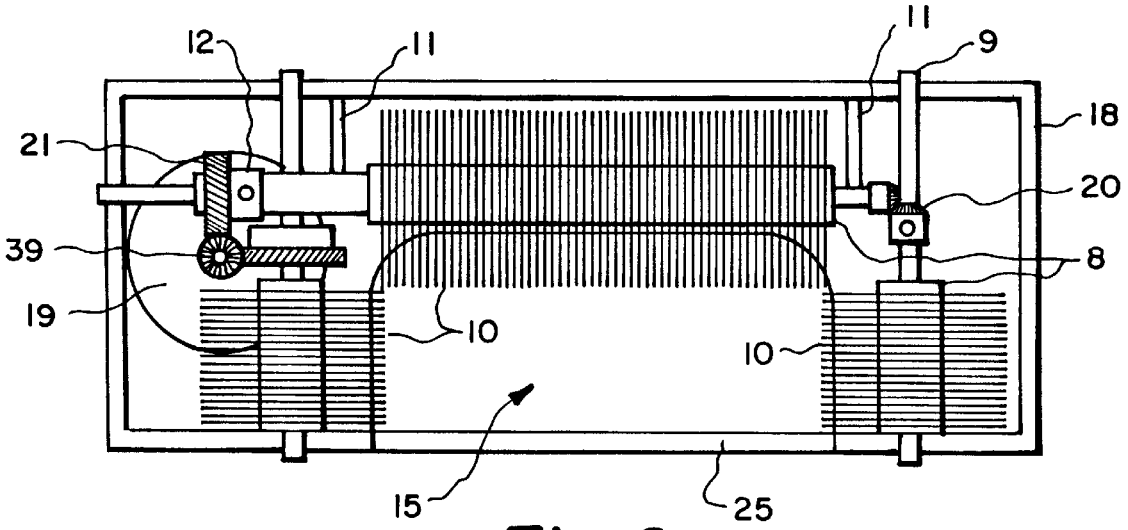
FIG. 8 is a frontal plan view of the operation of the club head cleaning device illustrating the gearing and cylinder configuration for delivering rotational power through a single power shaft.

The configuration of the cylinders holding the bristles for providing cleaning are illustrated in the cross sectional view of FIG. 3. In the cross sectional view of FIG. 3, three upper horizontal cylinders 8 connected by shaft or struts 9 are rotated by a gearing configuration 12 (FIG. 8). Three upper horizontal cylinders 8 are mounted on an inner housing 18 of module 1 and are held together by six supports 11. Six vertical cylinders 8 identical with the horizontal cylinders line the two sides of club head cleaning module 1. These cylinders 8 are covered with cleaning bristles 10 which in operation vigorously abrade a club head surface as will be described in greater detail hereinafter.

Figure 7:
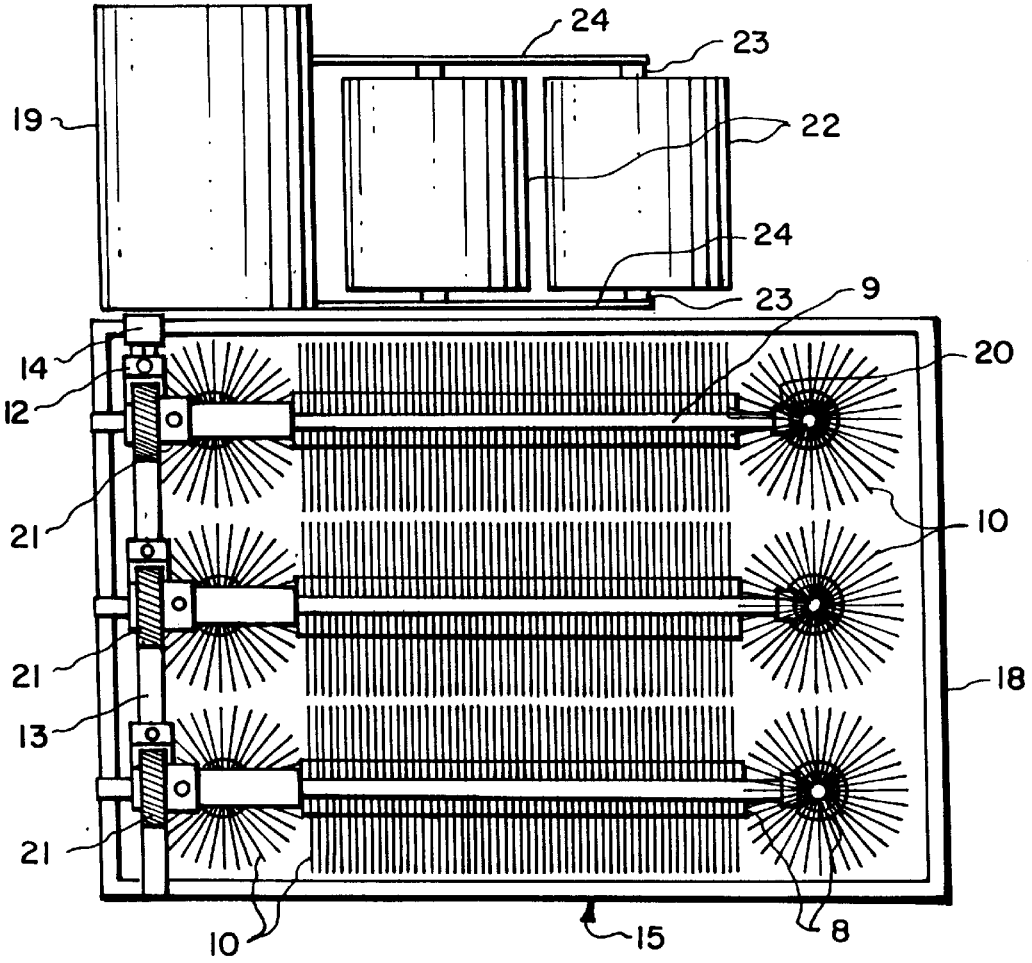
FIG. 7 is a top plan view illustrating the details of the gearing configuration and functional components of the interior of the golf club head cleaner including the brushes, shafts, and gearing struts arranged for the operation of three sets of brushes.

The gear arrangement of the components or brushes formed by cylinders 8 in bristles 10 is shown in greater detail in FIGS. 7 and 8. This arrangement gives a cleaning area of approximately 270° from the club face to the bottom and top of the club face where debris usually collects. A composition of the brushes formed by cylinders 8 and bristles 10 can be of various design with readily available cylinders and bristles or bristles made of a stiff synthetic. It is only important that the bristles not be so abrasive as to damage or scratch the golf club head. Power shaft 13 extends from micro-motor 19 and is powered by nickel cadmium rechargeable batteries 22 connected by battery tabs 23 and tab connectors 24 positioned adjacent micro-motor 19.

Figure 4A:
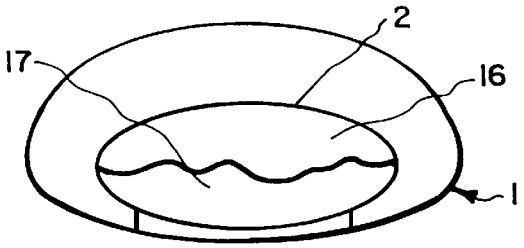
FIGS. 4*a* and 4*b* are comprised of detail frontal view of golf club cleaning module with FIG. 4*a* illustrating details of the resilient flaps at the entrance to the club head cleaner and FIG. 4*b* illustrating the placement of rotating sets of cleaning brushes. These figures also illustrate how the bottom of the module may be removed to accommodate larger club heads such as those on drivers.
Figure 4B:
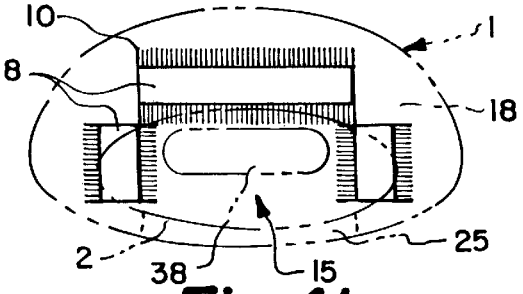

FIGS. 4*a* and 4*b* are frontal views of the club head cleaning module. FIG. 4*b* illustrates the structure but with the contoured housing illustrated in phantom for clarity. FIG. 4*a* is a frontal view showing the front opening 2 of club head cleaning module 1 having resilient flap 16 with slit 17 covering entrance slot 15 through which the golfer inserts a dirty club head for cleaning. Access to the interior of club head cleaning module 1 through slot 17 in resilient flap 16 permits access of the cylinder bristles to clean a club head in a 270° fashion. FIG. 4*b* illustrates the position of the respective cylinders 8 and bristles 10 which engage a club head 38 inserted through slot 17 in resilient flat 16. The area indicated at 38 is the area where the club head 7 engages the respective club cleaning bristles 10. Preferably club head cleaning module 1 has a removable bottom area 25 allowing a golfer to clean larger club heads such as those on drivers if desired.

Figure 5A:
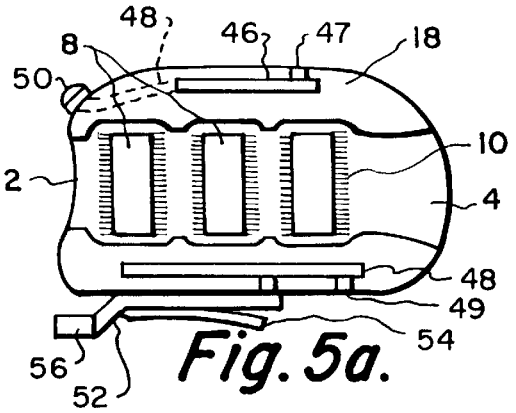
FIGS. 5*a* and 5*c* are cross sectional views taken through the center of the side view of the module illustrated in FIG. 5*b* illustrating the respective configuration of cleaning brushes within the contoured-molded housing in relation to the operational components described in greater detail hereinafter.
Figure 5C:
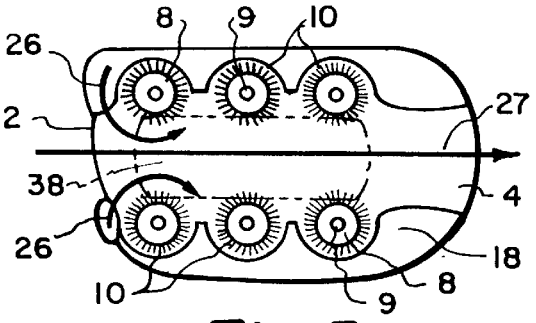
Figure 5B:
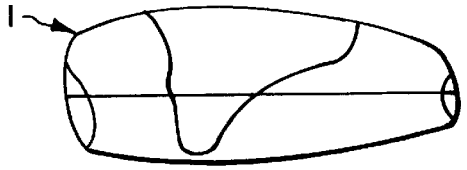

FIGS. 5*a* and 5*c* are respective sectional views taken by splitting club head cleaning module 1 of FIG. 5*b* through the center. FIG. 5*a* illustrates details of the cylinder 8 configuration and three upper horizontal brushes comprised of cylinders 8 and bristles 10. FIG. 5*c* illustrates the two sets of vertical cylinders 8 lined with bristles 10 and powered shaft or struts 9 in either side of module housing 18. The rotation of cylinders 8 and the creation of debris flow path 27 is indicated at 26 which allow debris to flow from entry hole 2 to cleaning area 38 and out through exit hole 4.

Figure 6:
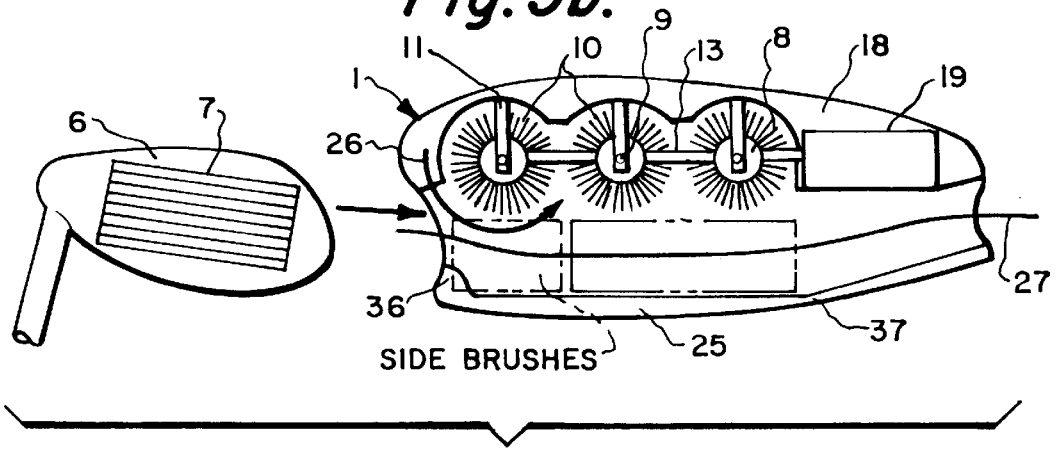
FIG. 6 is a cross sectional side elevation illustrating insertion of a club head into the golf club head cleaner and the flow path of debris cleaned off the club head.

FIG. 6 is a further detail of the portable club head cleaning module with a side cover removed revealing inner housing 18 which supports operational components such as micro-motor 19, batteries 22 and 23 and cylinders 8 with bristles 10 forming the respective cleaning brushes. Side walls in housing 18 support each end of cylinder 8. Micro-motor 19 is affixed to the rear of housing 5 of module 1 and is mounted by a water-tight adhesive or other water resistant sealer. Power shaft 13 connects micro-motor 19 to cylinders 8. Cylinders 8 have a respective shaft or strut 9 to facilitate rotational motion so that bristles 10 may perform a cleaning operation. Cylinders 8 are contained within module housing 18 in a manner well known to those skilled in the art.

In detail cylinders 8 have cylindrical housing supports 11 mounted on cylindrical housing struts or shafts 9. Cylindrical housing strut 9 is secured at both ends to housing 18 of module 1. This diagram also illustrates the direction debris is ejected by flow path 27 when cleaned from a club head 6 and related club head grooves 7. Preferably flow path 27 is channel-like in nature. The channel forms from the rotation of the nine respective brushes formed by cylinders 8 and bristles 10. Six cylinders 8 rotate from the outside to inside which is created by the gearing configuration detailed in FIGS. 7 and 8 and described earlier with respect to FIG. 5. Flow path 27 is ii; further enhanced by rotational motion 26 from three horizontally mounted cylinders 8 which are held by six supports 11. These upper cylinders 8 rotate from top to bottom and front to back as indicated at 26. This figure also shows in detail button 36 that allows hinge 37 to be released to permit removable section 25 to be opened to allow a golfer to clean larger club heads such as those on drivers.

FIG. 7 is a top view of the operational components with the outer housing omitted for clarity. Power is delivered to micro-motor 19 by nickel cadmium battery 22 through the use of positive and negative battery tabs 23 and tab connectors 24. Micro-motor 19 rotates power shaft 13 through clutch 14 and gearing configuration 12. Upper horizontal bristles 10 are rotated through the use of respective bevel gears in related horizontal shafts or struts 9 which cylinders 8 are attached to.

All nine cylinders illustrated are rotated by a single power shaft 13 through the use of gearing configuration 12 involving the use of bevel gears. All nine cylinders are geared to one another and to main drive shaft 13. Cylinders on the left adjacent to micro-motor 19 are linked directly to power shaft 13 through worm gears while the vertical cylinders on the right miter or bevel gears 20. The insertion opening of the golf club head cleaner is indicated at 15 for reference purposes.

The component detailed configuration illustrated in FIG. 8 is a frontal view showing internal housing 18 and gearing operational components shown in the top view of FIG. 7. This figure illustrates rotational power delivered to vertical cylinders 8 on the left and right sides of the club cleaning module. Power shaft 13 (FIG. 7) drives gears 12, worm gears 21 and 39 which in turn power respective shaft or struts 9. Vertical cylinders 8 on the left are powered solely through worm gears 39. Vertical cylinders 8 on the right are powered through horizontal shaft or struts 9 anchored to housing 18 by supports 11 and end with three miter or bevel gears 20, one for each strut, to rotate the respective right struts 9. The insertion area for a golf club head is indicated at 15 for engagement with bristles 10 on cylinders 8. Removable portion 25 is preferably removed for direct access to bristles of brushes for cleaning larger club heads as was described previously.

Figure 9:
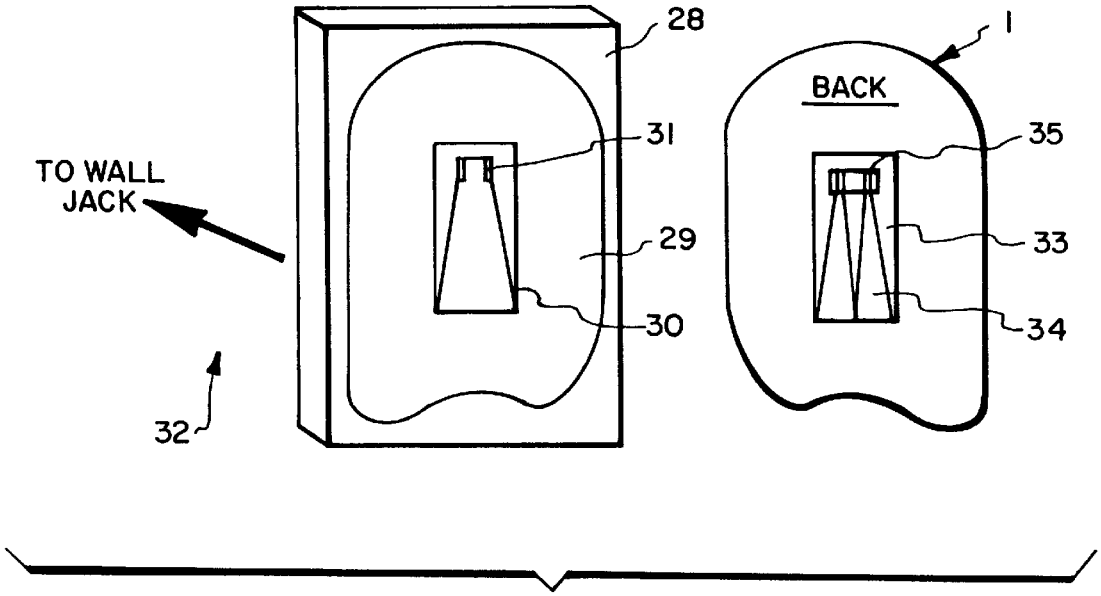
FIG. 9 is respective views of the rear of the club head cleaning module and a respective wall apparatus for receiving the module for recharging.
Figure 10:
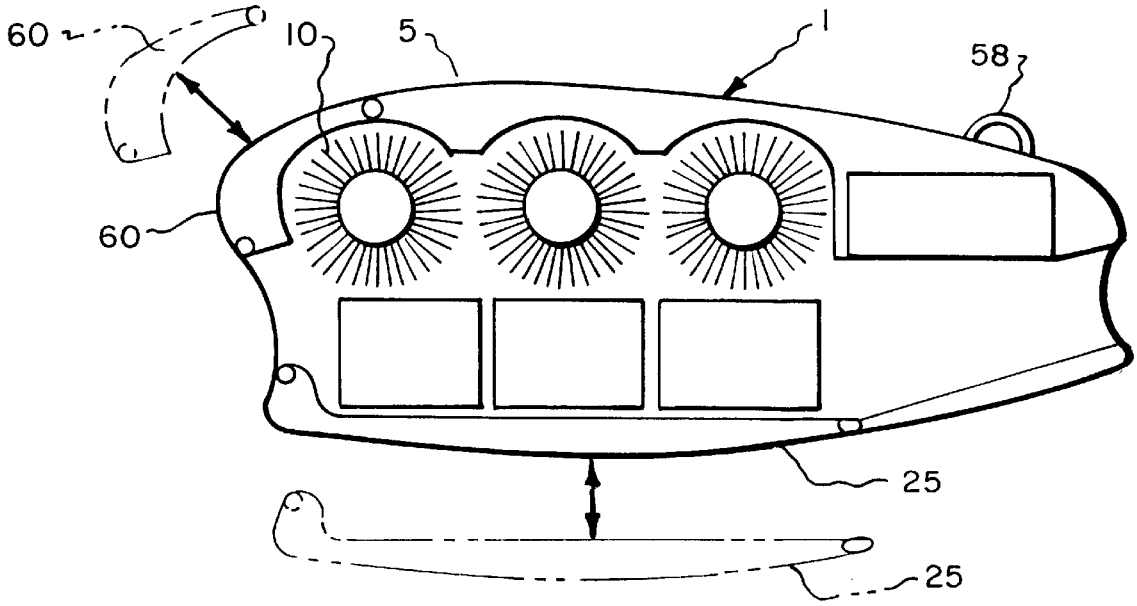
FIG. 10 illustrates the removable sections of the golf club head cleaner for spot cleaning and to clean larger club heads.

Another important but preferred aspect of the invention is that power is supplied through rechargeable nickel cadmium batteries. FIG. 9 is a diagram illustrating how the module would be recharged. Wall module 28 having a socket 30 will plug into any standard AC socket 32. The rear of club head cleaning module 1 has a module charge adapter 33 with twin access channels 34 allowing tab connector plate 35 and associated charge tabs in the module to be connected to wall module 29 recharge area. Wall module 28 has contoured molding 29 which allows module 1 to be inserted for recharging. Charge tabs 35 on module slide into access channel adapter 31 allowing connection to charge tabs adapter 31 to initiate the recharging process.

Many modifications of the basic configuration are possible. One such modification is illustrated in FIG. 3. In addition to or separately from the manually operated switch 3 and automatic switch 43 may be added at the entrance 15 to module housing 1. Switch 43 can be a micro-switch or other suitable switch that is automatically operated by insertion of a golf club head 6 through entrance 2 as illustrated at 15. In operation the rear of the golf club head or shaft will engage switch 43 and activate micro-motor 19 to instantly turn on and cause rotation of brushes formed by cylinders 8 and bristles 10.

Another optional but preferred feature is the inclusion of a spin boost circuit for operation with manual switch 3. Manual switch 3 will be a two-tiered switch. Primary activation allows for general cleaning operation. Complete depression of switch 3 activates a second button located immediately behind the first button that may also be depressed to activate a spin boost. The boost increases the rotational speed of cleaning cylinders 8 during the time the second button is applied.

Figure 11:
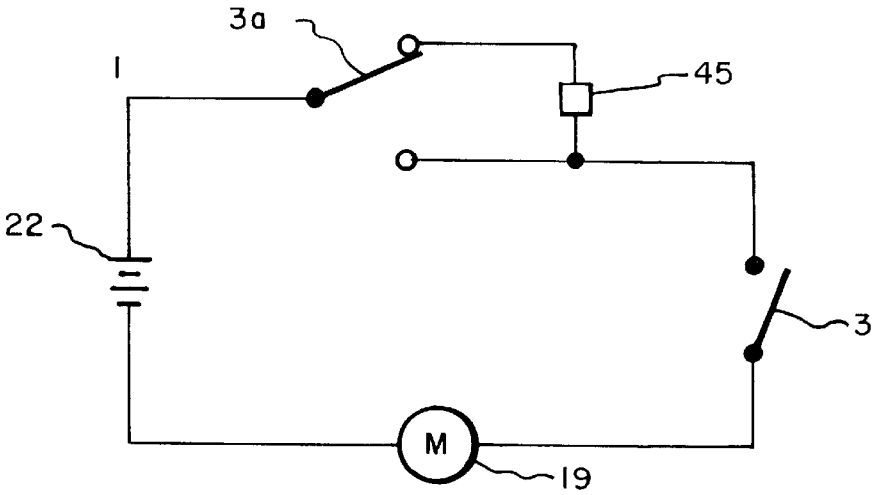
FIG. 11 is a schematic illustrating two speed operation of the golf club head cleaner.

The operation of this feature is illustrated schematically in FIG. 11. Switch 3 when activated operates micro-motor 19 through rechargeable batteries 22. Further depression activates a second switch 3*a* which applies full power through the circuit to micro-motor 19 applying a spin boost. The variation of speed of cleaning brushes are controlled by speed selector 45 which can be any suitable current blocking element such as a diode to reduce the power to micro-motor for standard operation and allow full power to be applied to boost the rotational speed of the brushes.

Another optional but preferred feature of the invention is the ability to moisten the club face with a cleaning solution or water prior to cleaning. A small amount of water may be applied to the club face if dry cleaning does not remove all the debris. Often grass stains will remain on the club face and although they may not seriously affect play they can cause the problem of the ball sliding off the club face which could produce an errant shot. A small amount of water may be applied to the face of a golf club by one of two methods. It may be sprayed on the club face or applied by a moistened sponge to wipe the face of the club.

The moistening option is illustrated in FIG. 5*a*. Golf club head cleaning module 4 is provided with reservoirs 46 and 48 for holding a small amount of water which will be sufficient for at least one round of play. Preferably only one of these options would be provided, either the moistening sponge or the spay but not both. Both are illustrated in FIG. 4*a* for purposes of illustration. Reservoir 46 is connected by small tube 48 to sponge 50. Applying pressure to sponge 50 draws water from reservoir 46 by capillary action into sponge 50. A club head face can then be wiped on sponge 50 before insertion through inlet 2 for cleaning by bristles 10.

Optionally a spray attachment 52 connected to second reservoir 48 can be provided. In this embodiment spray attachment is operated by trigger 54 to spray a fine mist of cleaning solution on the club face drawn from reservoir 48. A player positions a club face adjacent to sprayer nozzle 56 and operates trigger 54 to spray a fine mist of moisture on the club face. This should be sufficient to clean off any debris remaining on the face of the club head. A cleaning solution or water is added to reservoir 46 and 48 either by opening the housing or through ports 47 and 49 that may be provided in the housing.

Golf club head cleaning module 1 is also provided with a mounting loop 58 attached to the rear of housing 5. Loop 21 allows the portable golf club head cleaning module 1 to be hung from a golf bag or from a golf cart as desired.

In addition to the bottom section 25 of housing 5 being removable for insertion of larger club heads, a small cap section 60 at the front of housing may be removable for spot cleaning. Removal of a portion of the frontal section of the housing 5 would allow a small area of the club face to be pressed against the bristles 10 for cleaning a small area or spot on the club head. Front section 30 snaps off housing 5 allowing access to bristles 10. With section 60 removed a player can manipulate a club head face against bristles 10 for spot cleaning.

This invention is not to be limited by the embodiment shown in the drawings and described in the description which is given by way of example and not of limitation, but only in accordance with the scope of the appended claims.

What is claimed is:

1. A portable golf club cleaning apparatus comprising;

a housing having an entrance aperture contoured to receive a golf club head;

a first plurality of parallel brushes adjacent said entrance constructed and arranged to engage the face of said golf club head inserted in said entrance aperture;

a second plurality of brushes substantially perpendicular to said first plurality of brushes constructed and arranged to engage at least the sole of said golf club head when inserted in said entrance;

a driver for simultaneously driving said first and second plurality of brushes when said golf club is inserted in said entrance, said driver including a battery operated micro motor and a drive shaft connecting said battery operated micro motor to said first plurality of brushes, said second plurality of brushes being interconnected with said first plurality of brushes for operation therewith by said drive shaft;

activating means for activating said driver;

whereby a golf club head may be inserted in said entrance and cleaned of debris by rotation of said first and second plurality of brushes.

2. An apparatus according to claim 1 in which said housing includes an exit aperture in line with and at an end opposite said entrance aperture of said housing constructed and arranged to discharge debris out of said housing as it is cleaned from said golf club head by said first and second plurality of brushes.

3. An apparatus according to claim 2 in which a side of said housing can be opened for cleaning larger golf club heads.

4. An apparatus according to claim 3 in which said first plurality of rotatable brushes comprises three parallel brushes.

5. The apparatus according to claim 4 in which said activating means comprises an on/off switch on an exterior of said housing positioned for easy operation by a finger.

6. The apparatus according to claim 5 including reverse means for reversing rotation of said first and second plurality of brushes to effect deep cleaning of grooves in said club head face.

7. The apparatus according to claim 5 including a speed booster for boosting the rotational speed of said first and second plurality of brushes to improve cleaning.

8. The apparatus according to claim 7 in which said speed booster comprises a second switch and speed selector means to vary the speed of said battery operated micro-motor.

9. An apparatus according to claim 8 including a moistener mounted in said housing for moistening a club face before insertion in said portable club head cleaning apparatus.

10. An apparatus according to claim 9 in which said moistener comprises; a reservoir for storing a cleaning solution; and an applicator for applying said cleaning solution to a club face.

11. An apparatus according to claim 10 in which said applicator comprises a sponge.

12. An apparatus according to claim 10 in which said applicator comprises a spray nozzle connected to said reservoir.

13. The apparatus according to claim 2 in which said activating means comprises automatic activating means for automatically activating said portable golf club cleaning apparatus when a club head is inserted in said entrance aperture.

14. The apparatus according to claim 13 in which said automatic activating means comprises a micro-switch engaged when said club head inserted in said entrance aperture.

15. The apparatus according to claim 2 including mounting means for mounting said portable club cleaning apparatus at a convenient location.

16. The apparatus according to claim 15 in which said mounting means comprises a loop formed on said housing.

17. The apparatus according to claim 2 including access means to provide access to said cleaning brushes for spot cleaning a club face.

18. The apparatus according to claim 17 in which said access means comprises a removable section at a front of said housing providing access to a cleaning brush.

19. An apparatus according to claim 1 including a configuration of gears interconnecting said first and second plurality of brushes with said drive shaft.

20. An apparatus according to claim 19 in which said gear configuration comprises bevel gears interconnecting said first and second plurality of brushes and a worm gear connecting said first plurality of gears with said drive shaft.

21. An apparatus according to claim 20 in which said second plurality of brushes are equal to the number of said first plurality of brushes.

22. An apparatus according to claim 21 in which there are at least three of said first and second plurality of brushes.

* * * * *